United States Patent [19]

Kane et al.

[11] Patent Number: 4,885,689

[45] Date of Patent: Dec. 5, 1989

[54] MULTILINGUAL CODE RECEIVERS

[75] Inventors: Mark E. Kane; James F. Shockley; Henry H. Eck, all of Montgomery County, Md.

[73] Assignee: Pulse Electronics, Inc., Rockville, Md.

[21] Appl. No.: 41,089

[22] Filed: Apr. 22, 1987

[51] Int. Cl.[4] ..... B61L 3/00; B61B 13/16

[52] U.S. Cl. ..... 364/424.01; 340/825.13; 246/167 R; 375/121

[58] Field of Search ..... 246/1 C, 7, 8, 167 R; 340/870.01, 870.4, 825.13; 375/121; 455/142, 143; 370/79; 379/97, 93; 364/424

[56] References Cited

U.S. PATENT DOCUMENTS

| | | | |
|---|---|---|---|
| H,241 | 3/1987 | Duffy | 340/825.52 |
| 3,384,033 | 5/1968 | Ruff | 246/182 R |
| 4,241,398 | 12/1980 | Carll | 375/121 |
| 4,493,021 | 1/1985 | Agrawal et al. | 364/200 |
| 4,582,280 | 4/1986 | Nichols et al. | 246/167 R |
| 4,688,170 | 8/1987 | Waite et al. | 379/93 |

FOREIGN PATENT DOCUMENTS

| | | | |
|---|---|---|---|
| 0746674 | 7/1980 | U.S.S.R. | 340/870.01 |
| 0849524 | 7/1981 | U.S.S.R. | 340/870.01 |
| 0858061 | 8/1981 | U.S.S.R. | 340/870.01 |

OTHER PUBLICATIONS

J. Hanousek, "Frame Synchronisation in PCM Telemetry Systems", Sdelovaci Tech. (Czechoslovakia), vol. 26, No. 12 (Dec. 1978), pp. 449–452.

*Primary Examiner*—Parshotam S. Lall
*Assistant Examiner*—Tuan A. Duong
*Attorney, Agent, or Firm*—Whitham & Marhoefer

[57] ABSTRACT

A telemetry receiver which is capable of automatically recognizing certain incompatible code formats and correctly decoding received data from a remotely located telemetry transmitter is disclosed. The specific embodiment is an end of train receiver mounted in the cab of a locomotive which receives encoded transmissions, including encoded brake pipe pressure data, a transmitter mounted on the last car of a train. The receiver permits telemetry equipment to be "mixed-and-matched"; that is, the receiver in the locomotive will respond to the transmissions of a telemetry transmitter attached to the last car of the train no matter what the vendor source. The telemetry receiver is provided with a microprocessor which analyzes the received transmission. The microprocessor is programmed to recognize certain known transmission protocols and formats and then invoke the correct routine for decoding the received data.

7 Claims, 9 Drawing Sheets

MULTILINGUAL CODE RECEIVERS

BACKGROUND OF THE INVENTION

1. Field of the Invention

The present invention generally relates to telemetry receivers used for monitoring and testing telemetry equipment and, more particularly, to multilingual code receivers which are capable of recognizing certain incompatible code formats and correctly decoding received data.

2. Description of the Prior Art

A recent development in the operation of railroad equipment has been the elimination of cabooses from freight trains. The caboose, as the last car in the train, was provided with a gauge to monitor the brake pipe air pressure. It was the job of the brakeman riding in the caboose to notify the engineer in the locomotive cab on a periodic or as required basis the status of the brake pipe air pressure at the end of the train. This was accomplished by a voice radio system which communicated between the caboose and the locomotive cab and allowed the brakeman to talk to the engineer.

The caboose is being replaced with telemetry equipment in the form of a battery powered monitoring and transmitter package which is mounted on the coupler of the last car of the train and a receiver mounted in the locomotive cab. The monitoring and transmitter package periodically measures and transmits encoded data on not only brake pipe air pressure, but also on the battery condition and other conditions such as motion of the last car in the train. The monitoring and transmitter package is required by Federal regulation to having a flashing light of specified intensity and beam pattern, and data relating to the condition and operation of this light might also be transmitted to the telemetry receiver in the locomotive cab. In short, this end of train telemetry equipment has the capability of providing the engineer with more information on the conditions at the rear of the train with more accuracy and reliability than a brakeman riding in a caboose whose attention might be diverted at a critical time. Moreover, the telemetry receiver is typically connected to data processing circuitry which can filter the data, displaying only that data the engineer needs to see and providing a timely alert to the engineer when an emergency condition is detected.

An example of an end of train telelmetry system such as described above is disclosed in U.S. Pat. No. 4,487,060 to Pomeroy. However, the leading exponent for the development and standardization of end of train telemetry systems has been the Association of American Railroads, hereinafter the AAR. The work of the AAR has been reported from time to time in various publications early examples of which are the *TTD Post-Conference Proceedings,* "Enhancing Train Operations Through On-Board Processing: The Advanced Locomotive Cab Instrumentaion System", by Ambrose, Kiger and Patel, Nov. 27 to 29, 1979, The Palmer House, Chicago, Ill., pp. 195 to 206, and *Annual Proceedings of the Railway Fuel and Operating Officers Association, Inc.,* 1981: transcript of presentation by Steve Kiger, Consultant of the AAR, pp. 177 to 180 and 182 to 186.

Among the standards developed and promulgated by the AAR are the radio frequency specifications, encoding and data format of the telemetry transmissions. These have evolved over a period of years, but they were not without competing private standards developed by vendors of telemetry equipment. This has meant that equipment from various vendors have not been compatible. This has become a serious problem for some railroads which have purchased from more than one vendor, and can be a problem in any major rail depot where equipment from several vendors may be installed on different trains.

On the one hand, it would be desirable for a railroad to have test receiver equipment which can be used by railroad personnel to monitor transmissions from telemetry transmitters to assist them in testing and evaluation of the transmitters in their maintenance and repair operations. This has generally required the design and manufacture of different receivers for each different vendor source of telemetry equipment. The manipulation of more than one receiver in a laboratory is bothersome, but in the field the job becomes almost impossible creating many chances for error. On the other hand, railroads desire standardization of equipment for efficient operation. There has thus arisen a strong demand that the telemetry equipment can be "mixed-and-matched"; that is, the receiver in a controlling locomotive of a train will respond to the transmissions of a telemetry transmitter attached to the last car of the train no matter what the vendor source. Obviously, one way to accomplish this is to conform to the AAR standards. Unfortunately, there is now a large installed base of incompatible telemetry equipment from different vendors which does not conform to the AAR standards.

SUMMARY OF THE INVENTION

It is therefore an object of this invention to provide a telemetry receiver which can be used with any one of several telemetry transmitters without regard to the vendor source of the transmitters.

It is another object of the invention to provide a receiver which is capable of detecting which of several code formats is being transmitted and then correctly decoding the encoded data in the transmission.

It is further and more specific object of the invention to provide an end of train telemetry receiver for mounting in a locomotive cab which will correctly decode encoded transmissions from a variety of telemetry transmitters which may be mounted at the end of the train but which may use different transmission protocols or data formats.

According to the invention, the telemetry receiver is provided with a microprocessor which analyzes the received transmission, either in real time or by sampling buffered data in the receiver. The microprocessor is programmed to recognize certain known transmission protocols and data formats and then invoke the correct routine for decoding the received data.

BRIEF DESCRIPTION OF THE DRAWINGS

The foregoing and other objects, aspects and advantages of the invention will be better understood from the following detailed description of several preferred embodiments with reference to the drawings, in which:

FIG. 10 is a flow chart of a fourth version of a data format recognition scheme according to the invention; and FIG. 11 is a flow chart of a fifth version of the data format recognition scheme according to the invention.

DETAILED DESCRIPTION OF THE PREFERRED EMBODIMENTS OF THE INVENTION

Figure 1B:
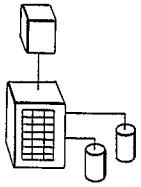
FIGS. 1, 1A and 1B are pictorial diagrams illustrating a railroad train and indicating the transmission from an end of train telemetry package to a receiver in the locomotive cab.
Figure 1A:
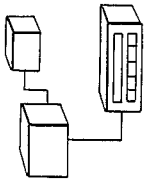
Figure 1:
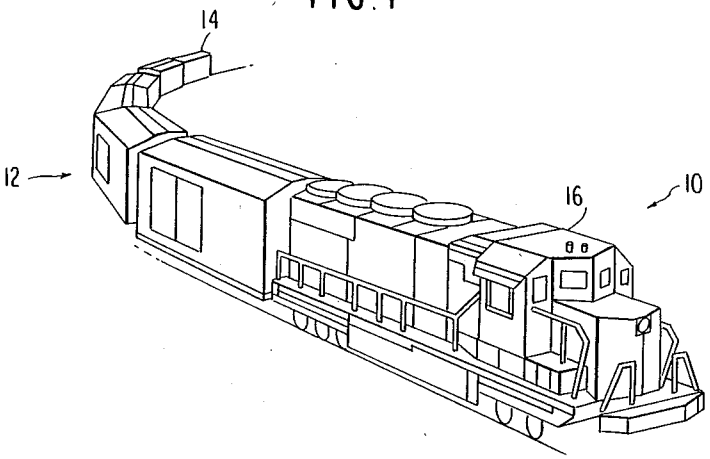

Referring now to the drawings, and more particularly to FIG. 1, there is shown the environment in which the preferred embodiments of the invention were developed. As described, a train including a locomotive 10 and several cars 12 is provided with an end of train telemetry package which is attached to the last car 14 of the train. This telemetry package monitors at least the brake pipe air pressure and periodically transmits encoded data to a receiver located in the cab 16 of the locomotive. Though not shown in this simple pictorial illustration, the train usually comprises a great many cars, perhaps one hundred or more, and is pulled by three or four locomotives. Each locomotive is similarly equipped, but the receiver of only the lead locomotive is turned on and tuned to receive the transmissions from the telemetry transmitter at the end of the train.

Figure 2:
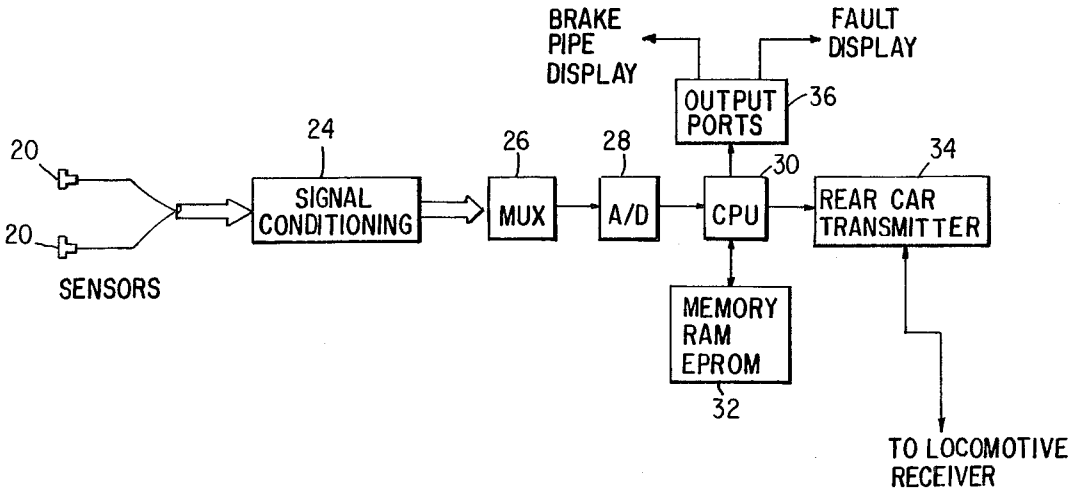
FIG. 2 is a block diagram illustrating, in generalized form, the monitoring and transmitting equipment at the end of the train.

FIG. 2 shows in generalized block diagram form the type of equipment in the telemetry package at the end of the train. One or more sensors 20 are connected to monitor conditions at the rear of the train. One of these sensors would be connected to a fitting attached to the brake pipe and provide an output electrical signal indicative of the air pressure sensed in the brake pipe. The output electrical signal is connected to signal conditioning circuits 24, which would include signal amplifiers and filters, to provide one or more amplified signals to a multiplexer 26. The output of the multiplexer 26, corresponding to a selected one of the output signals from the signal conditioning circuits 24, is supplied to an analog-to-digital converter 28 which generates a binary number, typically eight bits or one byte in size, that can be input to the central processing unit (CPU) 30. The CPU 30 is a commercially available microprocessor such as an Intel 8085 or Motorola 6805, both of which are examples of well known 8-bit microprocessors. The CPU 30 is provided with memory 32 comprising random access memory (RAM) and electrionically programmable read only memory (EPROM). The data input from the analog-to-digital converter 28 is temporarily stored in the RAM by the CPU 30 which formats this data with other information before outputing the formatted data to the transmitter 34 for modulation and transmission to the receiver located in the locomotive cab. In additon, the CPU 30 provides outputs through output ports 36 for display at the end of train telemetry unit. This display can be read by yard maintenance personnel usually by pressing a push button switch provided for the purpose. The CPU 30 is controlled by a program which is stored in the EPROM of memory 32.

Figure 3:
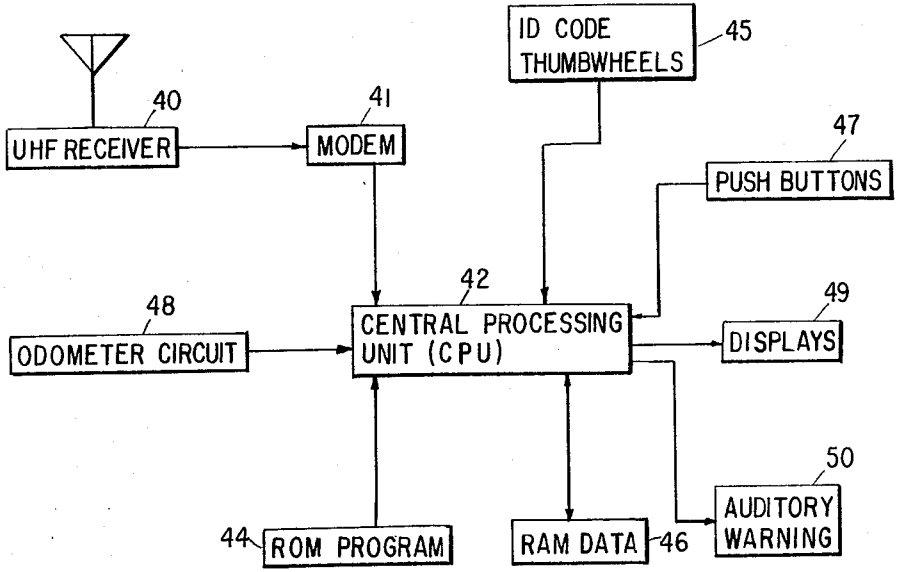
FIG. 3 is a block diagram illustrating, again in generalized form, the receiving and data processing equipment mounted in the locomotive cab.

FIG. 3 shows in block diagram form the receiver and control unit which is located in the locomotive cab. The receiver 40 is a superheterodyne receiver of conventional design which is provided with signal processing circuitry that provides a binary encoded data stream output via a modem (modulation and demodulation) 41 to the CPU (central processing unit) 42. The CPU 42 is provided with memory in the form of a ROM (read only memory) 44 which stores the program that controls the CPU 42 and a RAM (random access memory) 46 which is used to store data. The CPU 42 has a further input/output port connected to an odometer circuit 48 to provide an input that is used to correlate events with distance traveled. Other input/output ports are connected to ID code thumbwheels 45, push buttons 47, displays 49, and an auditory warning circuit 50. The ID code thumbwheels 45 are used to dial in an identification code so that the receiver will respond only to the transmitter having that identification code which has been attached to the last car on the train. The push buttons 47 provide a user input to the CPU 42, and the displays 49 and auditory warning 50 provide user outputs from the CPU 42. These input/output ports are not important to an understanding of the present invention and, therefore, will not be discussed further.

The CPU 42 has an input 47 from a key pad or switches which typically includes a thumbwheel 31 for dialing in the identification code of the transmitter attached to the last car of the train. Further, the CPU 42 generates outputs to a visual diaplay 49 on the instrument panel of the locomotive for displaying data to the engineer. An emergency condition, when detected, is announced to the engineer both by the visual display 49 and by an auditory warning 50, also connected to an output of the CPU 42.

It is the function of the CPU 42 to receive the binary encoded data from the reciever 40 and decode the data for processing and ultimately displaying the data, under the control of the program stored in the ROM 44. The first step of this process is achieve frequency, bit and frame synchronization with the data transmission.

Frequency synchronization is achieved in the receiver 40 by conventional radio techniques. Bit synchronization is achieved either by the modem 41 or the CPU 42 under program control. Frame synchronization is achieved by the CPU 42 under the control of the program stored in ROM 44. Once synchronization is achieved, the CPU 42 can extract data from the transmitted frame of data for decoding and further processing. The format of the data which the receiver and control unit expects to receive is stored in the program, and decoding proceeds in a manner well understood by those skilled in the art.

The problem arises, however, when a data format other than that for which the CPU 42 was originally programmed is transmitted, as when the transmitter from a vendor source different from that of the receiver control unit is attached to the rear of the train. Changing receivers in the locomotive cab to match the equipment attached to the last car of the train is neither a practical or acceptable solution. Requiring the engineer to know that different data transmission formats may exist and then to act on that knowledge by selecting among receivers or programs is also neither practical or acceptable.

Figure 4:
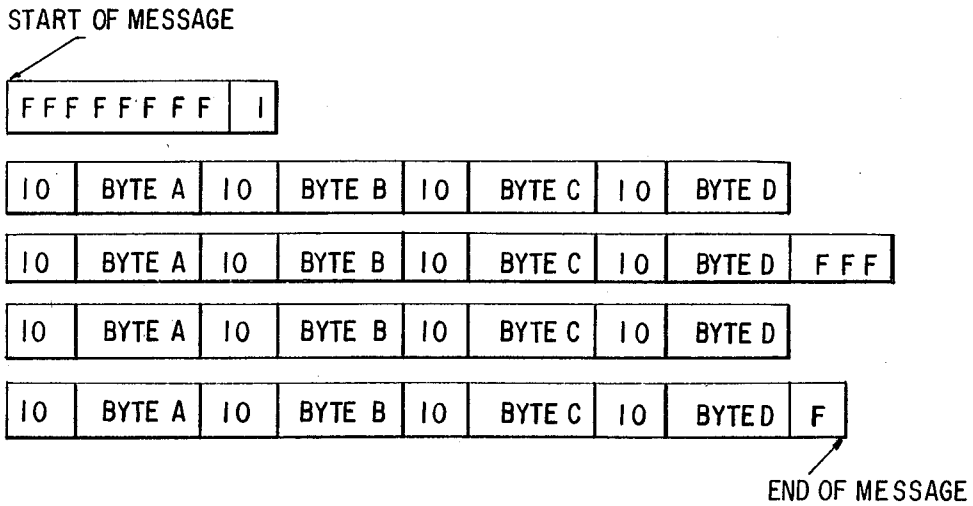
FIG. 4 is a simplified diagram of the AAR train information system message format.

To better appreciate the problem, it is necessary to understand the types of data formats currently in use on installed equipment. Considering first the AAR data message format for end of train telemetry equipment, reference may be had to "Guidelines, Considerations and Radio Frequency Specification for Train Information Systems", Fifth Edition, Revised Dec. 18, 1984, Track Train Dynamics (TTD), a committee of the AAR, 3140 South Federal Street, Chicago, Ill. The general format of any message to be sent is a series of blocks, of fixed length, which contain the data that is to be sent to the front of the train. This format is illustrated in FIG. 4. Every message sent will always have at least one block, namely the Basic Block. Additional blocks may or may not be sent depending upon the number of optional features built into a system.

At the beginning of every block in the message, a series of sixty-nine (69) synchronization bits is sent to establish bit synchronization and assist in frame synchronization. Following the synchronization bits is an eleven (11) bit "Barker code", a sequence of bits easily and reliably distinguishable from the synchronization bits, which provides frame synchronization. Immediately following the Barker code there is a forty-five (45) bit data sequence for the block and an eighteen (18) bit BCH error detection/correction code. The block is ended by a trailing bit which is designed to enable the receiver to reliably extract the last bit(s) in the BCH code. The total length of every message block is 144 bits.

The initial block contains all the information which is sent by any basic system. Included within this initial block is the message type identifier, a unique identification number, rear brake pipe pressure information, motion indications, marker light status, battery condition, and discretionary information. Following the basic block are optional blocks which contain data from other optional system features that are not provided for in the basic system message. The number of optional blocks, and hence the total length of the message, will vary depending upon the number of options included in the rear unit, if any, and the strategy the vendor uses for transmitting data to the cab unit. Some messages sent by the rear unit will have no optional blocks since all the information to be conveyed is contained in the basic block.

Figure 5:
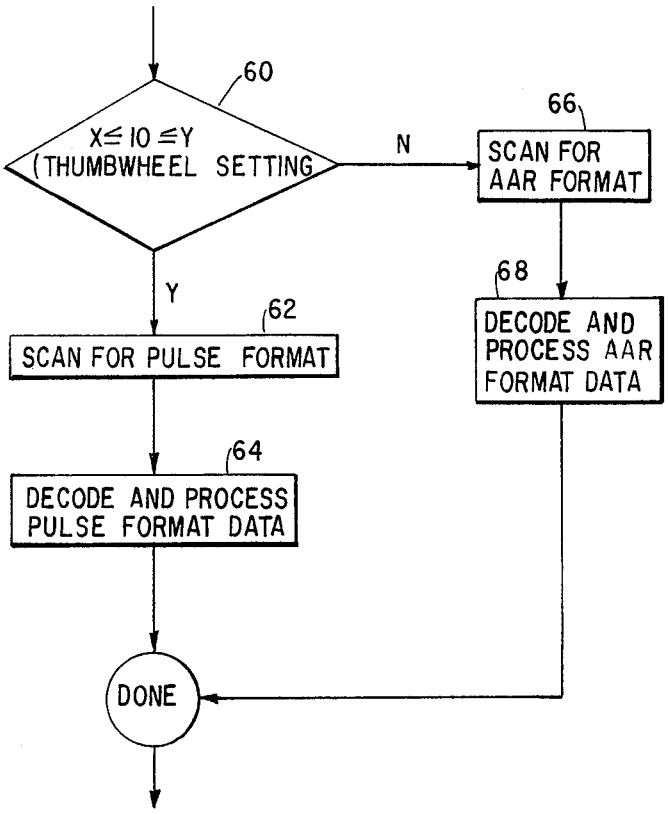
FIG. 5 is a more detailed diagram of the data format of the basic block of data transmitted in the AAR message format.

Specific details of the message format are shown in FIG. 5. Immediately preceding the start of every basic block transmission, a series of sync bits are sent to allow the transmitter and receiver to settle and establish bit and frame synchronization. The AAR bit sync is a 69 bit pattern of alternating zeros and ones. The frame sync is an eleven bit Barker code (01001000111), where the right most bit is the least significant bit (LSB) which is transmitted first. The chaining bits are a two bit code which provide information about the position of the current data block within the overall message being received. Chaining bits indicate whether the block is the first block, the last block, or an intermediate block in the message.

In the AAR message format, the first data transmitted is the battery condition. This is followed by a message type identifier which is a 3-bit code defining the type of message being transmitted. This information is used by the receiver and control unit in the locomotive cab to identify the format of the message received and enable correct decoding of the contents. Following the message type identifier is the rear unit's unique address code which is a number within the range of 00000 to 99999 requiring seventeen bits. The AAR has assigned blocks of numbers to vendors of end of train equipment so that no two end of train units will have the same address code no matter what their vendor source.

The rear brake pipe status and pressure data is a 7-bit message element. This is followed by eleven bits of discretionary information at the option of the vendor. Additional transmitted data includes motion detection data, marker light battery condition data, and marker light status data. The formatted data block is completed by a basic block BCH 18-bit error detection/correction code and a "trailer" bit.

Figure 6:
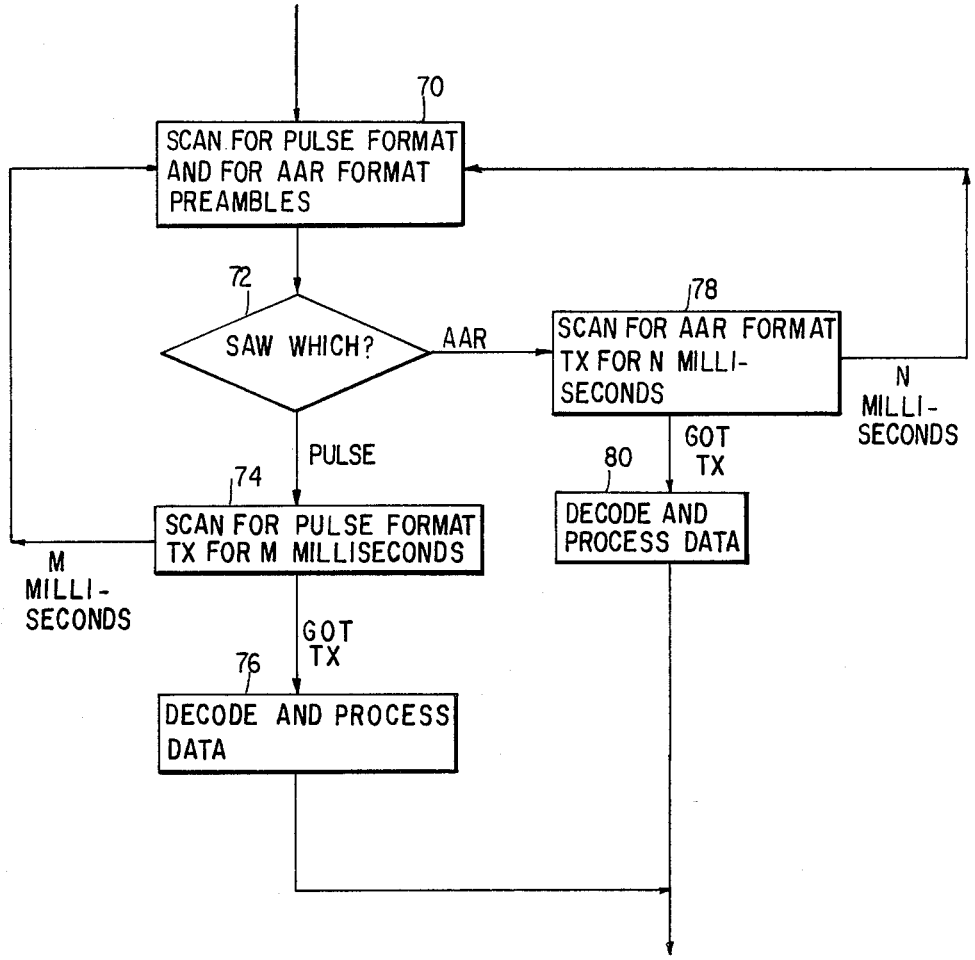
FIG. 6 is a simplified diagram of the message format used by a vendor of end of train telemetry equipment.

In spite of the seeming flexibility built into the AAR data format as indicated, for example, by the message type identifier, there exist variations on the AAR format which are totally incompatible. These variations include specifications of bit synchronization as well as order of data in the transmitted data frame. Moreover, there exists a format used by Pulse Electronics, Inc., of Rockville, Md., for their end of train equipment which is totally different from the AAR format and its variations. The basic format of the Pulse data frame is shown in FIG. 6. The basic concept of this format is that multiple transmissions of the data which provides both frame synchronization and data redundancy for error detection thereby eliminating the need for a separate transmission of frame sync data and of complex error detection/correction codes. A variation of this data frame format is described in more detail in U.S. Pat. No. 4,599,723 to Henry H. Eck, one of the co-inventors of the invention disclosed and claimed herein.

Thus, as described above, there exist three different data formats currently in use in end of train telemetry equipment. These are the AAR format, a variant of the AAR format, and the Pulse format. None of these formats is compatible with one another, and while there is a trend toward standardizing on the AAR format, there exists an installed base of equipment using these different formats. For any one of these formats, it is a straightforward engineering problem to decode the data transmitted assuming that you know the format and synchronization specifications of the received encoded data. For the engineer in the locomotive cab, the receiver and control unit should be capable of responding to the transmitter unit at the end of the train. To that end, the engineer is required to dial into the receiver and control unit, using thumbwheels, the unique transmitter address between 00000 and 99999 of the transmitter unit which is attached to the last car of his train. Beyond that, the engineer can not be expected to know the details of the transmission characteristics of the equipment installed on his train.

It is therefore the purpose of this invention to provide the capability to automatically recognize the type of equipment attached to the last car of the train and then to invoke the correct synchronizing and decoding scheme in the receiver and control unit installed in the locomotive cab. Alternatively, the invention provides the same function in a test receiver which may be used by both laboratory and field technicians to test and troubleshoot end of train telemetry equipment from various vendors. The purposes of the invention are accomplished in several versions which will be described in more detail hereinafter. Each of these versions is described in terms of detecting one or the other of two different formats primarily for purposes of simplifying the description. However, those skilled in the art will recognize that these may be combined to permit detecting multiple formats.

Figure 7:
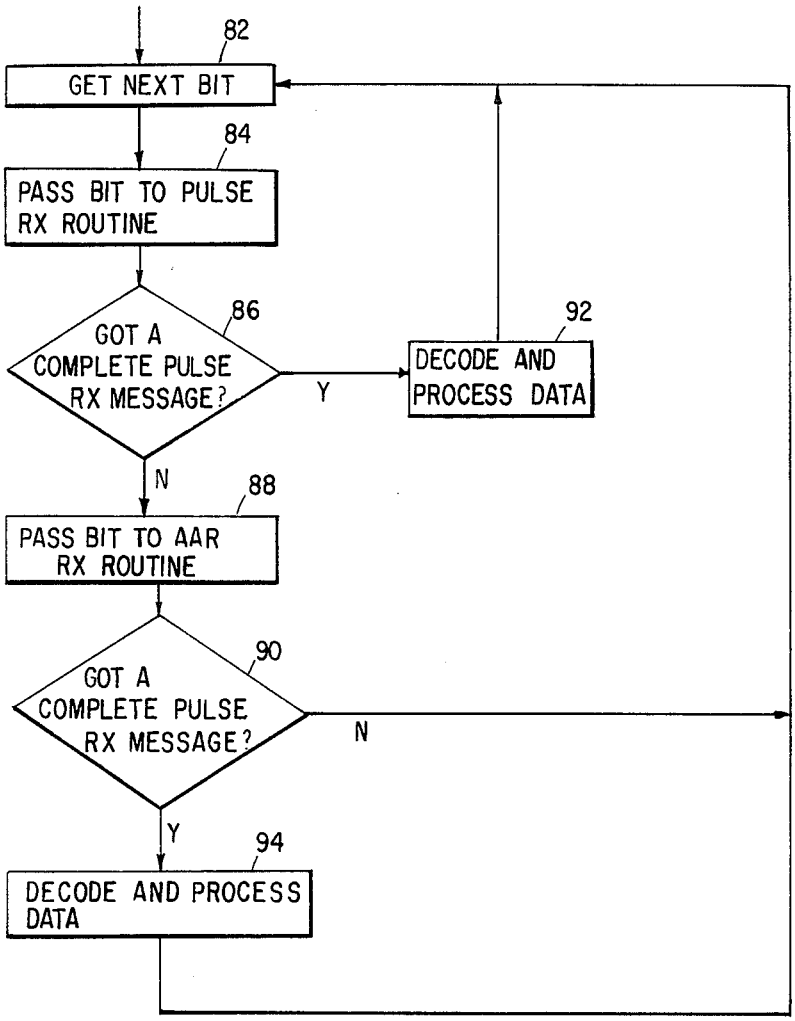
FIG. 7 is a flow chart showing a first version of a data format recognition scheme according to the invention.

Turning first to the flow chart shown in FIG. 7, the unit address code is tested in decision block 60 to determine if it is between a certain setting as input by the engineer on the thumbwheels. As previously mentioned, the AAR has assigned to vendors blocks of address codes for uniquely identifying each transmitter that is put in service. Assuming that the address code is between the limits indicated as "X" and "Y" in decision block 60, the receiver and control unit in the locomotive cab will expect the transmissions from the end of train unit to have the Pulse format. Thus, a received data transmission will be scanned in function block 62 for the Pulse format, and if that format is verified on a given transmission, the received data will be decoded and processed in function block 64. On the other hand, if the thumbwheel setting indicates equipment with the AAR format, then received data is scanned in function block 66 for the AAR format. Assuming that the AAR format is verified, the data is decoded and processed pursuant to that format in function block 68.

Figure 8:
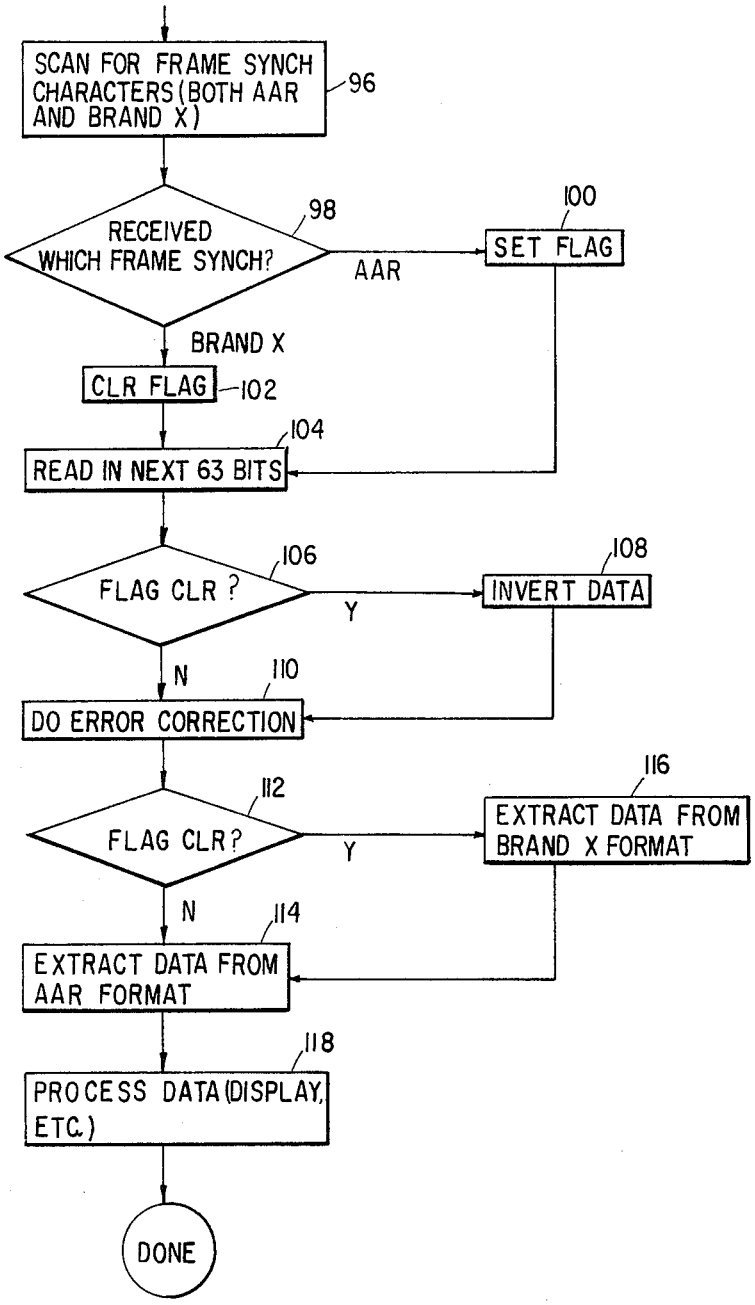
FIG. 8 is a flow chart showing a second version of a data format recognition scheme according to the invention.

The version shown in FIG. 7 has the advantage of simplicity but does not directly determine the format that is actually received. The version shown in FIG. 8 does not rely on the thumbwheel entry of the unique transmitter address code entered by the engineer. In this version, the received data stream is buffered or temporarily stored in whole or in part to allow the CPU to scan the preamble of a received data transmission as indicated by function block 70. A test is then made in decision block 72 to determine which of the Pulse or AAR format preambles has been received. If the Pulse format preamble has been detected, the received transmission is scanned in function block 74 using the Pulse protocol for a predetermined period of time to confirm that what has been received is in fact that protocol. If in that period of time, the Pulse protocol is not recognized, then the process loops back to function block 70. On the other hand, if the Pulse protocol is recognized, then the received data is decoded and processed in function block 76. A similar process occurs if the AAR format preamble is detected whereby the received data is scanned in function block 78 for a predetermined period of time to verify that the transmission is indeed in the AAR format. Note that the period of time for scanning of the received data assuming the AAR format is not the same as the period of time for scanning of the received data assuming the Pulse format. This is because the frames of data transmitted using the two protocols are of different lengths. Again, if the AAR format is verified in function block 78, then the received data is decoded and processed in function block 80.

Figure 9:
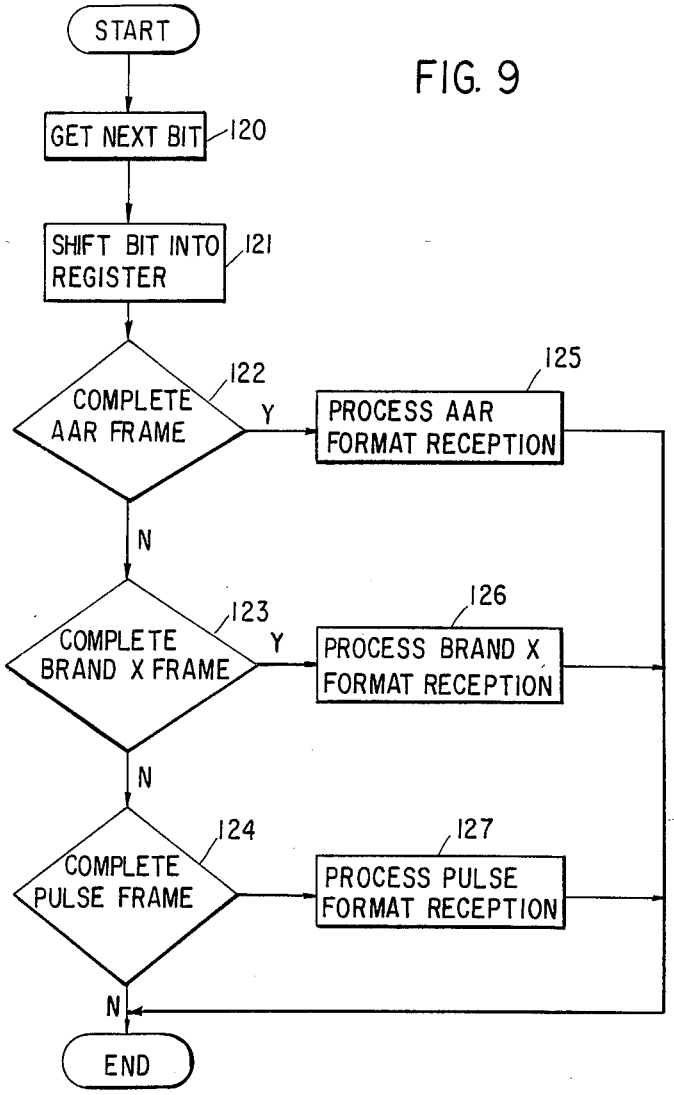
FIG. 9 is a flow chart of a third version of a data format recognition scheme according to the invention.

A different approach is taken in the third version shown in FIG. 9. In this case, each bit is examined as received. In function block 82, the next bit is retrieved and it is first passed to the Pulse decoding routine in function block 84. The accumulated data bits are tested in decision block 86 to determine if a complete Pulse message has been received. If not, the bit is also passed to the AAR decoding routine in function block 88. Again, the accumulated data bits are tested in decision block 90 to determine if a complete AAR message has been received. If not, the process loops back to function block 82 to retrieve the next data bit. The Pulse message is shorter than the AAR message, and so if a Pulse message is detected in decision block 86, then the message is decoded and processed according to the Pulse protocol in function block 92. If on the other hand, an AAR message has been received, that will be detected in decision block 90 and the message will be decoded and processed according to the AAR protocol in function block 94. What will be appreciated in the process shown in FIG. 9 is that both the Pulse and AAR receive routines are run simultaneously.

As mentioned, a third protocol exists which is a variant of the AAR protocol. For purposes of illustration, it is assumed that in the process shown in FIG. 10 the AAR protocol and this variant may be detected. One of the distinguishing characteristics of these two protocols is that the frame sync characters are distinctly different. Therefore, the first thing that is done in function block 96 is to scan for the frame sync characters. A decision is made in decision block 98 as to whether the AAR format or the variant of the AAR format has been detected. If the AAR format is detected, a flag is set in function block 100; otherwise, the flag is cleared in function block 102. Then the next 63 bits of data are read into a register in function block 104. The flag is tested in decision block 106, and if it is set, then the required error correction of the received data is performed in function block 108. If on the other hand, the flag has been cleared indicating the variant of the AAR format, then the data is inverted in function block 108 before performing the error correction function block 110. Again, the flag is checked in decision block 112, and if it is set, then the data is extracted from the AAR format in function block 114. If the flag is cleared, the data is extracted from the variant of the AAR format in function block 116. Once the data is extracted, the data is processed in function block 118.

While the several versions shown in FIGS. 7 to 10 differentiate between but two data message formats, it will be understood by those skilled in the art that these may be combined. For example, the versions shown in FIGS. 9 and 10 may be combined so that the Pulse format and the AAR and variant formats are processed simultaneously. The version shown in FIG. 7 may differentiate between all three formats by thumbwheel selection, and the versions shown in FIGS. 8 and 10 can be combined to differentiate between the three protocols. FIG. 11 generally illustrates these possibilities. In this flow chart, the program shifts bits one at a time into a buffer as indicated by function blocks 120 and 121. After the buffer is shifted, its contents are examined in each of decision blocks 122, 123 and 124 to see if it contains a complete message of any of the different formats. If any one of the tests is true, the message is processed according to the corresponding protocol and data format as indicated in function blocks 125, 126 and 127, respectively.

Moreover, the invention may be used in other and different applications where it is desirable to provide compatible communications between equipment from different manufacturers. Therefore, those skilled in the art will appreciate that the invention may be practiced with modification and variation within the spirit and scope of the appended claims.

Having thus described our invention, what we claim as new and desire to secure by Letters Patent is as follows:

1. A multilingual code receiver for use with end-of-train telemetry systems, said receiving means receiving and correctly decoding different data message formats from a remotely located end-of-train telemetry transmitter, said receiver comprising:

radio frequency receiving means for receiving data from said remotely located end-of-train telemetry transmitter;

means connected to said radio frequency receiving means for scanning a bit stream of said received data and determining which of said different data message formats has been received;

means responsive to said scanning means for extracting data from the received data message according to a detected data message format as determined by said scanning means; and means for decoding and processing extracted data.

2. A multilingual code receiver for use with end-of-train telemetry systems, said receiver receiving and correctly decoding at least two different data message formats from a remotely located end-of-train telemetry transmitter, said receiver comprising:

radio frequency receiving means for receiving transmissions from said transmitter and providing a digital bit stream output;

central processing means connected to said radio frequency receiving means for buffering said digital bit stream output, said central processing means being programmed to scan a buffered digital bit stream to determine which of said different data message formats was used to transmit data and then to extract, decode and process data according to a detected data message format; and output means connected to said central processing means for providing an output in response to processed data.

3. A multi-lingual code receiver as recited in claim 1 further comprising identification code means connected as an input to said central processing means for providing an input corresponding to a unique identification code associated with a single telemetry transmitter.

4. A receiver and decoding unit for use in end-of-train telemetry systems, said receiver and decoding unit being controlled by a central processing unit under the control of a stored program for automatically detecting which of several different data message formats have been received from a remote end-of-train telemetry transmitter, said central processing unit performing the following steps:

scanning a bit stream of the received data to determine which of said different data message formats was used to transmit the data;

extracting the data according to the detected data message format; and decoding and processing the extracted data.

5. An end of train telemetry receiver mounted in a locomotive cab capable of correctly decoding encoded transmissions from a variety of end-of-train telemetry transmitters which can be mounted at an end of the train but which can use different transmission protocols or data formats, said receiver comprising a microprocessor, a read only memory and a random access memory, said read only memory storing a program for controlling said microprocessor, said microprocessor operating under the control of said program and reading and writing data to said random access memory, said microprocessor functioning under said program to analyze a bit stream of a received transmission to determine which transmission protocol or data format was used to transmit data and then to decode the received transmission.

6. The multi-lingual receiver as recited in claim 5 further comprising identification input means connected to said microprocessor for inputting a unique identification number corresponding to a specific telemetry transmitter mounted at the end of the train.

7. The multi-lingual receiver as recited in claim 5 further comprising audio and visual output means connected to said microprocessor for supplying audio and visual output signals according to the decoded received data.

* * * * *

UNITED STATES PATENT AND TRADEMARK OFFICE

CERTIFICATE OF CORRECTION

PATENT NO. : 4,885,689

DATED : Dec. 5, 1989

INVENTOR(S) : Kane et al.

It is certified that error appears in the above-indentified patent and that said Letters Patent is hereby corrected as shown below:

In column 3, delete lines 4-8

In column 3, line 9, change "6" to --4--.

In column 3, line 11, change "7" to --5--.

In column 3, line 13, change "8" to --6--.

In column 3, line 16, change "9" to --7--.

In column 3, line 18, change "10" to --8--.

In column 3, line 21, change "11" to --9--.

In column 3, line 33, after "package", insert --, shown in Figure 1B,--.

In column 3, line 35, after "receiver", insert --, shown in Figure 1A,--.

In column 5, line 18, change "Figure 4" to --Table 1--, and before "Every", insert the following table, --Table 1

TRAIN INFORMATION SYSTEM MESSAGE FORMAT

| BASIC BLOCK | OPTIONAL BLOCK 1 | OPTIONAL BLOCK 2 |
|---|---|---|
| 144 bits | 144 bits | 144 bits-- |

UNITED STATES PATENT AND TRADEMARK OFFICE

CERTIFICATE OF CORRECTION

PATENT NO. : 4,885,689
DATED : Dec. 5, 1989
INVENTOR(S) : Kane et al.

It is certified that error appears in the above-indentified patent and that said Letters Patent is hereby corrected as shown below:

In column 5, line 53, change "Figure 5" to --Table 2--, and before "Immediately", insert the following table,

--TABLE 2

BASIC BLOCK

| | |
|---|---|
| Bit sync | 69 bits |
| Frame Sync | 11 bits |
| Chaining Bits | 2 bits |
| Device Battery Condition | 2 bits |
| Message Type Identifier | 3 bits |
| Unit Address Code | 17 bits |
| Rear Brake Status and Pressure | 7 bits |
| Discretion Information | 11 bits |
| Motion Detection | 1 bit |
| Marker Light Battery Condition | 1 bit |
| Marker Light Status | 1 bit |
| Basic Block BCH Code | 18 bits |
| Trailing Bit | 1 bit |
| Total Length | 144 bits-- |

In column 6, line 29, change "6" to --4--.

In column 7, line 8, change "7" to --5--.

UNITED STATES PATENT AND TRADEMARK OFFICE

CERTIFICATE OF CORRECTION

PATENT NO. : 4,885,689
DATED : Dec. 5, 1989
INVENTOR(S) : Kane et al.

It is certified that error appears in the above-indentified patent and that said Letters Patent is hereby corrected as shown below:

In column 7, line 28, change "7" to --5--.
In column 7, line 30, change "8" to --6--.
In column 7, line 60, change "9" to --7--.
In column 8, line 11, change "9" to --7--.
In column 8, line 15, change "10" to --8--.
In column 8, line 39, change "7" to --5--.
In column 8, line 39, change "10" to --8--.
In column 8, line 43, change "9" to --7-- and change "10" to --8--.
In column 8, line 45, change "7" to --5--.
In column 8, line 47, change "8" to --6-- and "10" to --8--.
In Column 8, line 49, change "11" to --9--.

Signed and Sealed this
Thirteenth Day of September, 1994

*Attest:*

*Attesting Officer*

Bruce Lehman

BRUCE LEHMAN

*Commissioner of Patents and Trademarks*